US008355656B2

(12) United States Patent
Okamoto et al.

(10) Patent No.: US 8,355,656 B2
(45) Date of Patent: Jan. 15, 2013

(54) IMAGE-FORMING APPARATUS

(75) Inventors: Masaya Okamoto, Yokohama (JP); Hideaki Tanaka, Yokohama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 321 days.

(21) Appl. No.: 12/875,658

(22) Filed: Sep. 3, 2010

(65) Prior Publication Data

US 2011/0217086 A1 Sep. 8, 2011

(30) Foreign Application Priority Data

Mar. 3, 2010 (JP) ..... 2010-046516

(51) Int. Cl.
*G03G 15/08* (2006.01)

(52) U.S. Cl. ..... 399/258

(58) Field of Classification Search ..... 399/107, 399/119, 120, 252, 258, 262
See application file for complete search history.

(56) References Cited

U.S. PATENT DOCUMENTS 7,792,468 B2 * 9/2010 Ichikawa et al. ..... 399/262
7,835,673 B2 * 11/2010 Hosokawa et al. ..... 399/258

FOREIGN PATENT DOCUMENTS

JP 2006-47520 A 2/2006
JP 2009-169251 A 7/2009

* cited by examiner

*Primary Examiner* — Hoan Tran
(74) *Attorney, Agent, or Firm* — Sughrue Mion, PLLC

(57) ABSTRACT

An image-forming apparatus includes: image-forming units arranged along a direction inclined at an acute angle relative to a horizontal direction, each of the image-forming units forming an image with developer; developer-containing units positioned above the image-forming units and arranged along the horizontal direction or along a direction inclined relative to the horizontal direction at an angle smaller than the acute angle; and developer conveyance paths that connect the image-forming units to respective developer-containing units, each developer conveyance path having a tubular passage that defines a space through which the developer contained in the developer-containing unit is conveyed to the image-forming unit, wherein the tubular passage of a developer conveyance path connected to an image-forming unit located at a position higher than that of another image-forming unit has a vertically extending portion shorter than that of the tubular passage of a developer conveyance path connected to the another image-forming unit.

9 Claims, 8 Drawing Sheets

IMAGE-FORMING APPARATUS

CROSS-REFERENCE TO RELATED APPLICATIONS

This application is based on and claims priority under 35 U.S.C. 119 from Japanese Patent Application No. 2010-46516, which was filed on Mar. 3, 2010.

BACKGROUND

1. Technical Field

The present invention relates to an image-forming apparatus.

2. Related Art

An image-forming apparatus of an electrophotography type typically is equipped with four image-forming units for forming images of yellow (Y), magenta (M), cyan (C), and black (K), respectively. Each image-forming unit has a developing unit for developing an electrostatic latent image with developer. Each developing unit is supplied with developer of a respective color from a developer container, otherwise referred to as a toner cartridge, via a developer conveyance path.

SUMMARY

In one aspect of the present invention, there is provided an image-forming apparatus including: plural image-forming units arranged along a direction inclined at an acute angle with respect to a horizontal direction, each of the plural image-forming units forming an image with developer; plural developer-containing units positioned above the plural image-forming units and arranged along the horizontal direction or along a direction inclined with respect to the horizontal direction at an angle smaller than the acute angle, each of the plural developer-containing units containing the developer supplied to an associated one of the plural image-forming units; and plural developer conveyance paths that connect the plural image-forming units to respective developer-containing units, each developer conveyance path having a tubular passage that defines a space through which the developer contained in the associated developer-containing unit is conveyed to the associated image-forming unit, wherein the tubular passage of a developer conveyance path connected to an image-forming unit located at a position higher than that of another image-forming unit has a vertically extending portion shorter than that of the tubular passage of a developer conveyance path connected to the another image-forming unit

BRIEF DESCRIPTION OF THE DRAWINGS

Exemplary embodiments of the present invention will now be described in detail with reference to the following figures, wherein.

DETAILED DESCRIPTION

<1. Exemplary Embodiment>

Figure 1:
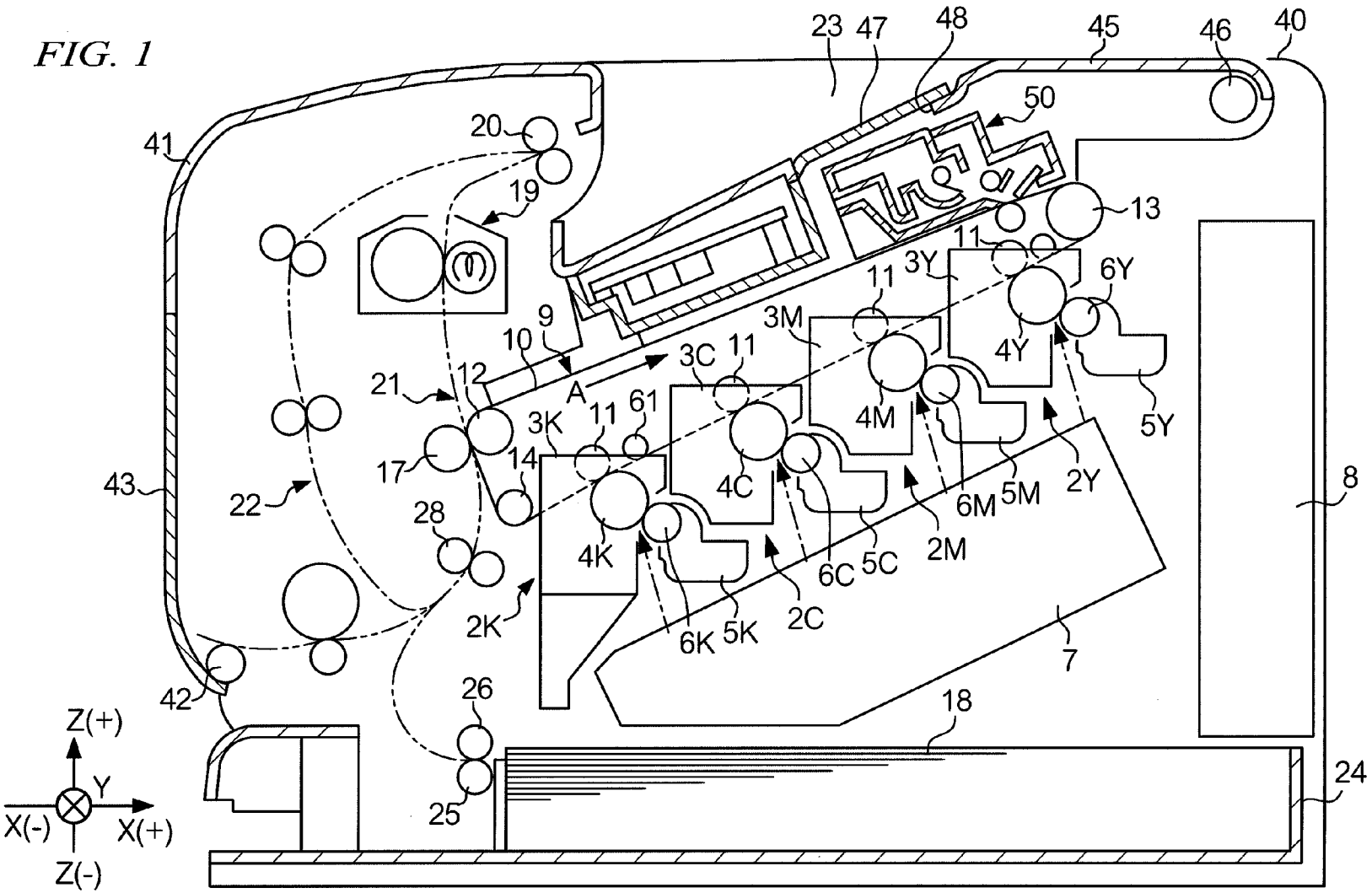
FIG. 1 schematically shows a configuration of an image-forming apparatus according to an exemplary embodiment of the present invention.
Figure 2:
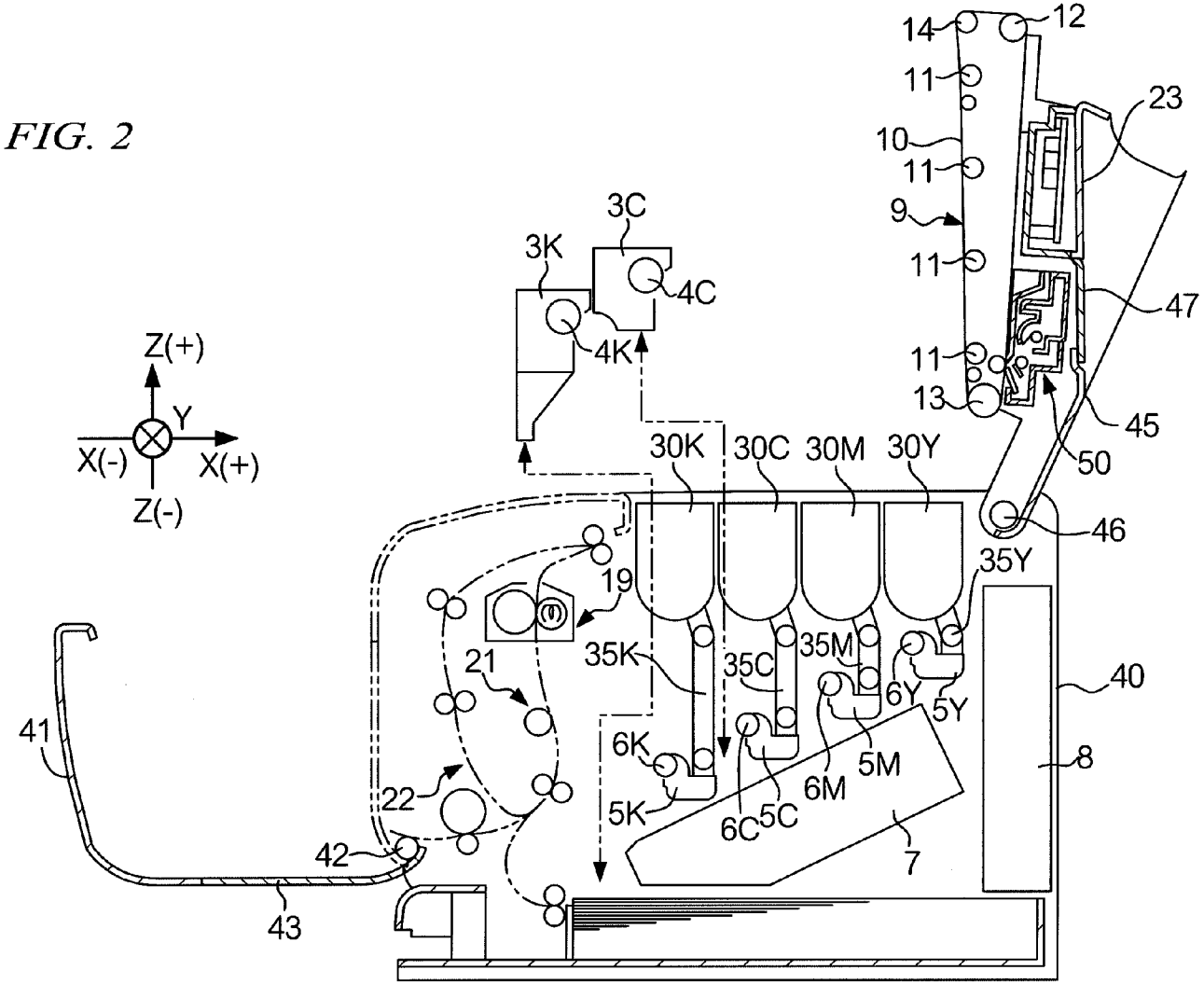
FIG. 2 is a cross-sectional view showing a state in which a lid member is opened.

In the following, explanation will be given of an exemplary embodiment of the present invention, with an image-forming apparatus, such as a printer, a copy machine, or a facsimile, being taken as an example. FIG. 1 schematically shows a configuration of an image-forming apparatus according to the exemplary embodiment, and FIG. 2 is a cross-sectional view showing a state in which a lid member is opened. In the following, description is given of image-forming apparatus 1 as viewed from the front of the apparatus, where the horizontal direction is denoted as the X-axis direction, with right/left directions from a viewer's perspective being indicated by X(+) and X(−), respectively; the front-back direction of image-forming apparatus 1 is denoted as the Y-axis direction, with back/front directions of image-forming apparatus 1 being indicated by Y(+) and Y(−), respectively; and the vertical direction is denoted as the Z-axis direction, with up/down directions being indicated by Z(+) and Z(−), respectively.

<Configuration of Image-Forming Apparatus>

Image-forming apparatus 1 is a full color printer of a tandem type, in which image-forming units are arranged in a line along an intermediate transfer belt. Image-forming apparatus 1 contains an image-processing unit (not shown) that performs image processing on image data received from a device such as a scanner or a personal computer (not shown), or received via a telecommunications line (not shown), etc. Further, inside image-forming apparatus 1 there are provided four image-forming units 2Y, 2M, 2C, 2K for yellow (Y), magenta (M), cyan (C), and black (K), respectively. These image-forming units 2Y, 2M, 2C, 2K are arranged such that they are spaced apart from one another in a generally horizontal direction and extend parallel to one another in the Y-axis direction. In this configuration, vertical positions of image-forming units 2Y, 2M, 2C, 2K are lower respective to one another in the order stated. Accordingly, image-forming unit 2Y, which performs the image transfer onto the intermediate transfer belt first, is positioned higher than image-forming unit 2K, which performs image transfer onto the intermediate transfer belt last, whereby a plane along which image-forming units 2Y, 2M, 2C, 2K are arranged is caused to incline at a predetermined angle (e.g., 20 degrees) relative to the horizontal direction (X-axis direction). By this arrangement, a length of image-forming apparatus 1 in the horizontal direction can be reduced compared to a case where image-forming units 2Y, 2M, 2C, 2K each are arranged at a same height along the horizontal direction.

Each of the four image-forming units 2Y, 2M, 2C, 2K essentially has the same structure, and thus, in the following description, where it is not necessary to distinguish between image-forming units 2Y, 2M, 2C, 2K, the image-forming units will simply be referred to as image-forming unit(s) 2 collectively.

Each image-forming unit 2 has photosensitive member unit 3 and developer unit 5. Photosensitive member unit 3 includes photosensitive drum 4, which serves as an image-holding member, and a charging device. Photosensitive member unit 3 can be installed in and removed from apparatus main body 40. Developer unit 5 is secured to apparatus main body 40 via a frame (not shown). Developer unit 5 has a toner container (not shown) for containing toner, a conveying member (not shown) for conveying toner to the toner container, and developer roller 6 for providing toner in the toner container to a surface of photosensitive drum 4.

In image-forming apparatus 1, developer units 5Y, 5M, 5C, 5K are arranged along a direction inclined at a set acute angle (e.g., 20 degrees) relative to the horizontal direction generally corresponding to that of the direction along which image-forming units 2Y, 2M, 2C, and 2K are arranged.

Below image-forming units 2Y, 2M, 2C, 2K, image exposure unit 7, which is common to image-forming units 2Y, 2M, 2C, 2K, is provided. Image exposure unit 7 has four semiconductor laser units (not shown) for emitting laser beams modulated in accordance with image data of respective colors (Y, M, C, K). The four laser beams emitted from these semiconductor laser units are deflected by a polygon mirror and, via optical elements such as a lens and a minor (not shown), are scanned over a charged surface of photosensitive drum 4Y, 4M, 4C, 4K of corresponding image-forming unit 2Y, 2M, 2C, 2K to form an electrostatic latent image. The electrostatic latent images formed on photosensitive drums 4Y, 4M, 4C, 4K are developed by developer rollers 6Y, 6M, 6C, 6K of developer units 5Y, 5M, 5C, 5K using developers each including a respective color toner, to form toner images of respective colors. The toner images of respective colors formed sequentially on photosensitive drums 4Y, 4M, 4C, 4K of image-forming units 2Y, 2M, 2C, 2K are transferred one on top of another by primary transfer rollers 11 to an outer surface (or an underside surface) of intermediate transfer belt 10, which is arranged over the top of each of image-forming units 2Y, 2M, 2C, 2K, and serves as an intermediate transfer member.

Intermediate transfer belt 10 is an endless belt-shaped member tension-supported by multiple rollers, such as drive roller 12, tension roller 13, and idler roller 14, such that intermediate transfer belt 10 circulates in a direction indicated by arrow A under rotation of drive roller 12, which is rotated by a drive motor (not shown). Intermediate transfer belt 10 has an upper moving section and a lower moving section, and the lower moving section is inclined with respect to the horizontal direction, with a downstream end of the lower moving section positioned lower than an upstream end of the same with respect to the direction of movement of the lower moving section. Intermediate transfer belt 10 is arranged such that the lower moving section is in contact with photosensitive drums 4Y, 4M, 4C, 4K of image-forming units 2Y, 2M, 2C, 2K. As intermediate transfer belt 10, a flexible film made of a synthetic resin, such as polyimide, may be used, with ends of the synthetic resin film being joined by welding or the like so as to form an endless belt member.

It is to be noted that intermediate transfer belt 10, primary transfer rollers 11, drive roller 12, tension roller 13, idler roller 14, and others, constitute intermediate transfer unit 9.

Recording sheets 18, having a prescribed size and being made of a prescribed material, and serving as recording media, are contained in sheet container 24 disposed inside image-forming apparatus 1, and are conveyed from sheet container 24 along sheet conveyance path 21 by multiple rollers. Recording sheets 18 are supplied from sheet container 24 one at a time by supply roller 25 and separation roller 26 for conveyance to registration rollers 28, where each sheet 18 is held temporarily. Registration rollers 28 are caused to rotate at a predetermined timing for further convey each recording sheet 18 to a secondary transfer position at intermediate transfer belt 10. At the secondary transfer position there is provided secondary transfer roller 17 on one side of intermediate transfer belt 10 and in opposing relation to drive roller 12 provided on the other side of intermediate transfer belt 10.

Secondary transfer roller 17 is urged against intermediate transfer belt 10 to press each recording sheet 18 against intermediate transfer belt 10 as the sheet moves between secondary transfer roller 17 and intermediate transfer belt 10. Toner images of yellow (Y), magenta (M), cyan (C), and black (K) provided in overlapping relation on intermediate transfer belt 10 are transferred onto recording sheet 18 under pressure of secondary transfer roller 17 and action of electrostatic force. Fixing unit 19 applies heat and pressure to recording sheet 18 onto which the toner images of respective colors have been transferred at the secondary transfer position, so as to fix the toner images on recording sheet 18. Thereafter, recording sheet 18 is discharged by discharge roller 20 onto sheet-receiving tray 23, which is provided at an upper portion of image-forming apparatus 1. Sheet conveyance path 21 also includes reversing mechanism 22 for reversing a front side and a back side of recording sheet 18.

On a lateral side of main body 40 of image-forming apparatus 1 is attached side cover 41, which is pivotable about support shaft 42 for opening and closing. Side cover 41 in turn is provided with manual sheet feed tray 43, which can be opened and closed relative to side cover 41. On an upper side of apparatus main body 40 there is provided lid member 45, which can pivot about support shaft 46 to be opened and closed. An upper surface of lid member 45 serves as sheet discharge tray 23, onto which recording sheets 18 having a toner image formed thereon are discharged. Further, operating unit 49 is provided on the upper side of apparatus main body 40. For example, operating unit 49 includes a ten-key pad for entering a number of recording sheets, and the like.

Generally, lid member 45 is kept closed relative to apparatus main body 40, and, as shown in FIG. 2, is opened when photosensitive member units 3Y, 3M, 3C, 3K are installed in or removed from apparatus main body 40. Attached to this lid member 45 is sub-lid member 47, which can be opened and closed relative to lid member 45. Sub-lid member 47 can be opened and closed independently of lid member 45, so that even when lid member 45 is closed relative to apparatus main body 40, opening 48 of lid member 45 can be opened by opening sub-lid member 47. Sub-lid member 47 is opened when a whole or a part of toner-collecting unit 50 is installed in or removed from apparatus main body 40.

<Toner Supply Paths to Developer Units>

Figure 3:
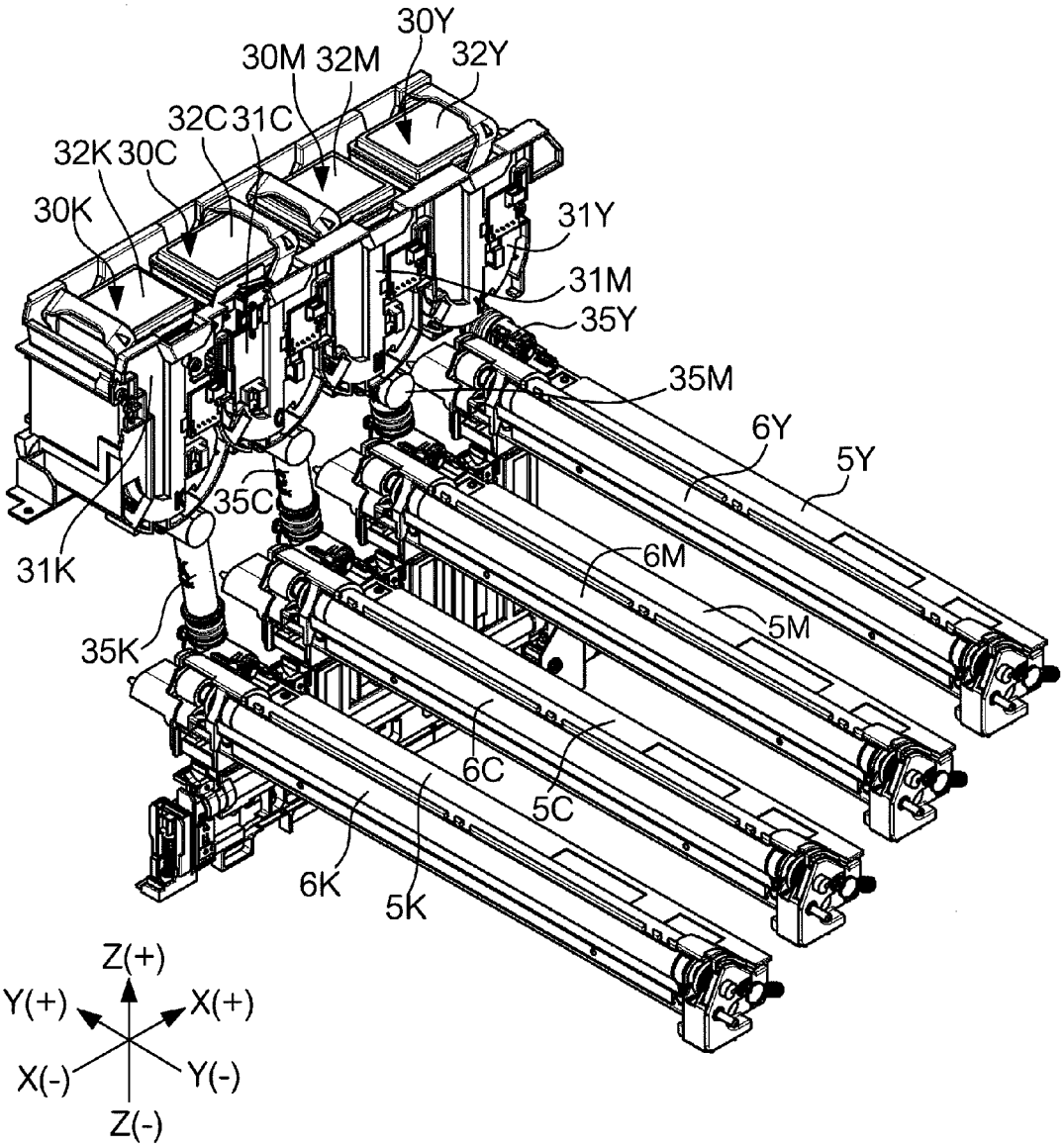
FIG. 3 is a perspective view showing toner-containing units, toner conveyance paths, and developer units.
Figure 4:
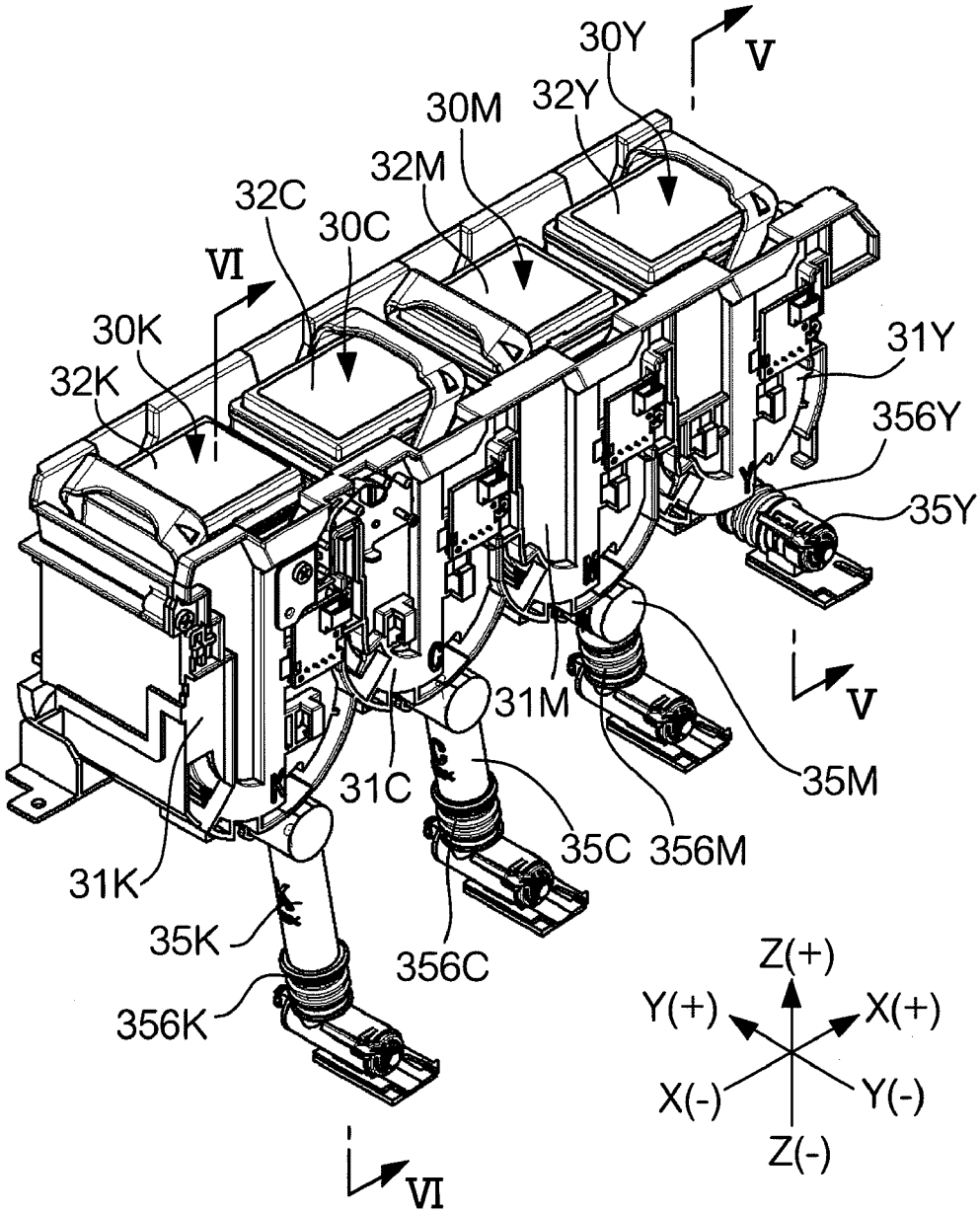
FIG. 4 is a perspective view showing toner-containing units and toner conveyance paths.
Figure 5:
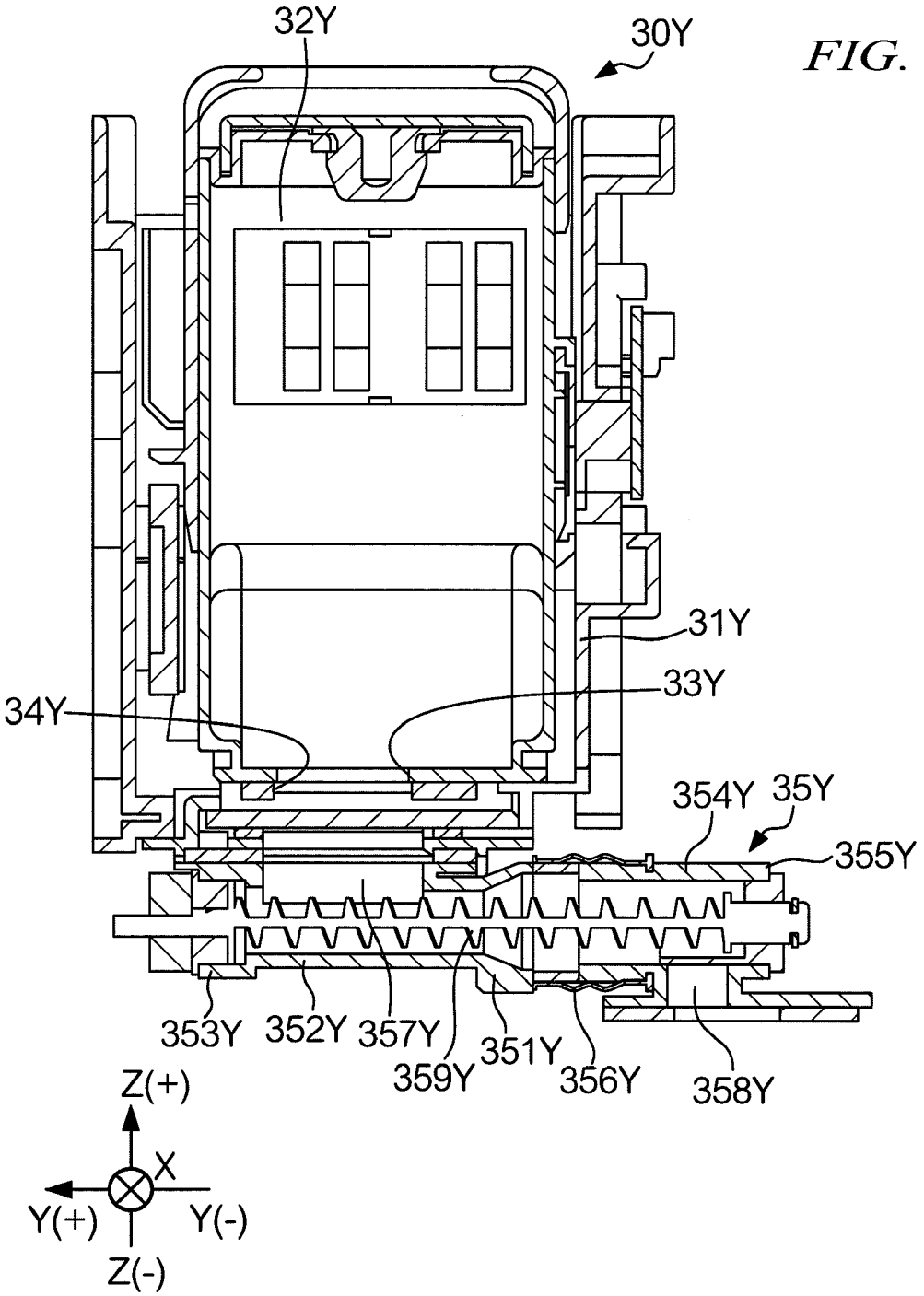
FIG. 5 is a cross-sectional view taken along line V-V in FIG. 4.
Figure 6:
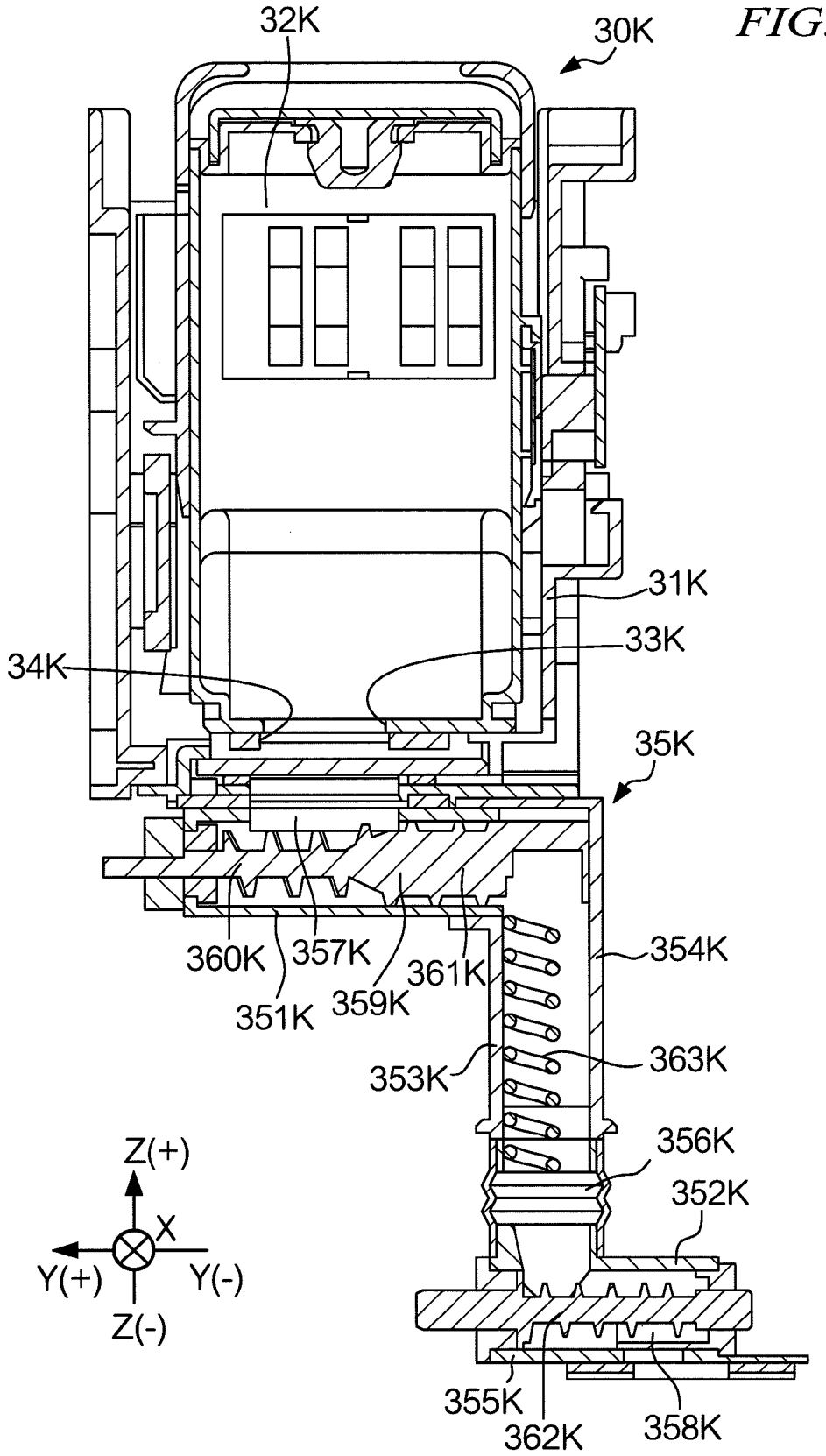
FIG. 6 is a cross-sectional view taken along line VI-VI in FIG. 4.

Next, with reference to FIGS. 2-6, explanation will be given of toner supply paths to developer units 5 of image-forming apparatus 1. FIG. 3 is a perspective view showing toner-containing units, toner conveyance paths, and developer units. FIG. 4 is a perspective view in which the developer units in FIG. 3 are omitted to show the toner-containing units and the toner conveyance paths. FIG. 5 is a cross-sectional view taken along line V-V in FIG. 4. FIG. 6 is a cross-sectional view taken along line VI-VI in FIG. 4. It should be noted that only the toner-containing unit and the toner conveyance path for black (K) are shown in FIG. 6. In the following description, where it is not necessary to distinguish between developer units for different colors, between toner-containing units for different colors, or between toner conveyance paths for different colors, the terms developer unit(s) 5, toner-containing unit(s) 30, and toner conveyance path(s) 35, are used respectively.

As shown in FIG. 2, toner-containing units 30Y, 30M, 30C, and 30K are provided on an upper (Z(+)) part of a backside (Y(−) side) wall of apparatus main body 40. Toner-containing units 30Y, 30M, 30C, and 30K are arranged at the same height along the horizontal direction (X-axis direction) above (on the Z(+) side of) developer units 5Y, 5M, 5C, and 5K with respect to a direction of gravity. Toner-containing units 30Y, 30M, 30C, and 30K are connected to developer units 5Y, 5M, 5C, and 5K via toner conveyance paths 35Y, 35M, 35C, and 35K, respectively. Each toner conveyance path 35Y, 35M, 35C, 35K serves as a developer conveyance path.

Since developer units 5Y, 5M, 5C, and 5K are arranged along a direction inclined with respect to the horizontal direction (X-axis direction), a distance between developer unit 5 and corresponding toner-containing unit 30 is different for different colors, so that a length of toner conveyance path 35 connecting developer unit 5 and corresponding toner-containing unit 30 is also different for different colors.

Specifically, the length of toner conveyance path 35Y connecting developer container 5Y, which is located at the highest position (Z(+) side) with respect to the direction of gravity, to toner-containing unit 30Y is the shortest, while the lengths of toner conveyance path 35M for connection of developer unit 5M, toner conveyance path 35C for connection of developer unit 5C, and toner conveyance path 35K for connection of developer unit 5K are greater respective to one another in the order stated. In other words, toner conveyance path 35 connected to developer unit 5 located at a higher position with respect to the direction of gravity has a shorter length.

In respective toner conveyance paths 35Y, 35M, 35C, and 35K, there are provided interference-suppressing portions 356Y, 356M, 356C, and 356K each having a bellow-like shape. These interference-suppressing portions 356Y, 356M, 356C, and 356K serve to suppress interference between oscillations in toner conveyance paths 35Y, 35M, 35C, and 35K and those in developer containers 5Y, 5M, 5C, and 5K.

Explanation will now be given of a configuration of toner-containing unit 30 with reference to FIGS. 3-6. Because each toner-containing unit 30Y, 30M, 30C, 30K has the same configuration, the suffixes Y, M, C, and K are omitted in the following description.

Toner-containing unit 30 includes container attachment portion 31 having an opening on its top side (Z(+) side) with respect to the direction of gravity, and toner container 32 received in container attachment portion 31.

Toner container 32 and container attachment portion 31 are provided in their bottom with respective openings 33 and 34 (see FIGS. 5 and 6), each having a shutter mechanism (not shown) that can be opened when toner container 32 is received in container attachment portion 31. Toner conveyance path 35 is connected to the bottom of container attachment portion 31. Toner container 32 can be attached to and detached from container attachment portion 31 when lid portion 45 is open as shown in FIG. 2.

Next, explanation will be given of a shape of toner conveyance path 35.

Toner conveyance path 35Y, which connects developer unit 5Y and toner-containing unit 30Y, and which serves as a developer conveyance path connected to one of the plural image-forming units that is positioned highest (i.e., one of the plural image-forming units that is positioned at a location higher than that of any other of the image-forming units), has a shorter length than the other toner conveyance paths 35, and includes only horizontal tubular passage 351Y, which extends horizontally (or in a direction parallel to a horizontal plane, which in this example is in the Y-axis direction) to define a space through which toner is conveyed. This horizontal tubular passage 351Y has first tubular section 353Y including small diameter portion 352Y, second tubular section 355Y including large diameter portion 354Y, and interference-suppressing portion 356Y, which is a bellows-like member made of rubber and connects first tubular section 353Y and second tubular section 355Y. Small diameter portion 352Y (e.g., ϕ9 mm) is positioned close to toner container 30Y, while large diameter portion 354Y (e.g., ϕ13 mm) is positioned close to developer unit 5Y. In an upper part (Z(+) side) of small diameter portion 352Y there is formed toner inlet port 357Y, which is connected to openings 34Y and 33Y. Also, in a bottom part (Z(−) side) of large diameter portion 354Y there is formed toner outlet port 358Y, which is connected to developer unit 5Y.

Within horizontal tubular passage 351Y there is provided conveying member 359Y whose axis extends in a direction of axis of horizontal tubular passage 351Y (Y-axis direction). This conveying member 359Y has a shaft with a diameter of 1 mm and vanes arranged on the shaft in a helical pattern with a pitch of 5 mm and a diameter of 7 mm. Conveying member 359Y is rotated by a rotating force transmitted from an external drive source via a train of gears, and conveys toner, which has fallen from toner container 30Y into horizontal tubular passage 351Y through toner inlet port 357Y, toward toner outlet port 358Y. An amount of toner conveyed by conveying member 359Y is determined by an area of each vane, the pitch, and a number of rotations of conveying member 359Y.

On the other hand, as shown in FIG. 6, toner conveyance path 35K, which connects developer unit 5K located at a lower position (Z(−) side) with respect to the direction of gravity and toner-containing unit 30K, and which serves as another developer conveyance path, has first and second horizontal tubular passages 351K and 352K, each extending horizontally (in the Y-axis direction) and having a diameter of 13 mm, for example, and vertical tubular passage 353, which extends along the direction of gravity (in the Z-axis direction) to connect first and second horizontal tubular passages 351K and 352K, where first and second horizontal tubular passages 351K and 352K serve as a first tubular passage and vertical tubular passage 353K serves as a second tubular passage. First horizontal tubular passage 351K, vertical tubular passage 353K, and second horizontal tubular passage 352K form a space through which toner is conveyed. First horizontal tubular passage 351K, which is located close to toner container 30K, and vertical tubular passage 353K are constituted, at least partially, of first tubular member 354K, which is bent in an L shape. Second horizontal tubular passage 352K, which is located close to developer unit 5K, has second tubular member 355K connected to first tubular member 354K via interference-suppressing portion 356K, which is a bellows-like member made of rubber.

In an upper part (Z(+) side) of first horizontal tubular passage 351K there is formed toner inlet port 357K, which is connected to openings 34K and 33K. Also, in a bottom part (Z(−) side) of second horizontal tubular passage 352K there is formed toner outlet port 358K, which is connected to developer unit 5K.

Within first horizontal tubular passage 351K there is provided first conveying member 359K having a shaft extending in a direction of axis of first horizontal tubular passage 351K (Y-axis direction), and vanes arranged on the shaft in a helical pattern with a pitch of 7 mm. This first conveying member 359K has small-diameter shaft portion 360K located at an upstream position with respect to a direction of conveyance of toner, and large-diameter shaft portion 361K located at a downstream position. Small-diameter shaft portion 360K has a shaft with a diameter of 4 mm, and vanes arranged in a helical pattern with a pitch of 7 mm and a diameter of 10 mm. Large-diameter shaft portion 361K has a shaft with a diameter of 9.6 mm, and vanes arranged in a helical pattern with a pitch of 7 mm and a diameter of 12 mm. This first conveying member 359K is rotated by a rotating force transmitted from an external drive source via a train of gears, and conveys toner, which has fallen from toner container 30K into first horizontal tubular passage 351K through toner inlet port 357K, toward vertical tubular passage 353K.

Within second horizontal tubular passage 352K there is provided second conveying member 362K whose axis extends in a direction of axis of second horizontal tubular passage 352K (Y-axis direction), and which has a shaft with a diameter of 4 mm and vanes arranged on the shaft in a helical pattern with a pitch of 5 mm and a diameter of 9 mm. This second conveying member 362K is rotated by a rotating force transmitted from an external drive source via a train of gears, and conveys toner, which has fallen into second horizontal tubular passage 352K through vertical tubular passage 353K, toward toner outlet port 358K.

Inside vertical tubular passage 353K there is provided toner-loosening member 363K, which is a coil-shaped member having an axis extending in a direction of axis of vertical tubular passage 353K (Z-axis direction). This toner-loosening member 363K oscillates in the vertical direction (Z-axis direction) in response to a force transmitted from an outside, and serves to cause the conveyed toner to gradually fall downward (Z(−) direction) with respect to the direction of gravity within vertical tubular passage 353K, and to suppress agglomeration of toner.

In FIG. 6, toner conveyance path 35K for black (K) is illustrated as an example. It is to be noted that each of toner conveyance paths 35M and 35C for magenta (M) and cyan (C), respectively, has the same configuration as that of toner conveyance path 35K except for their lengths, and therefore, explanation therefor is omitted.

As shown in FIGS. 1 and 2, in image-forming apparatus 1, four image-forming units 2Y, 2M, 2C, and 2K are arranged along a direction inclined at an angle with respect to the horizontal direction (X-axis direction), and therefore, the length of image-forming apparatus 1 in the horizontal direction (X-axis direction) is made smaller, as compared to a case where the image-forming units are arranged at the same height along the horizontal direction. Thus, a reduction in size of image-forming apparatus 1 in the horizontal direction is achieved. Further, in image-forming apparatus 1, toner conveyance path 35Y connecting developer unit 5Y located at the highest position and toner-containing unit 30Y is constituted of only horizontal tubular passage 351Y without any vertical tubular passage, and therefore, the length of image-forming apparatus 1 in a direction of height (Z-axis dimension) is made smaller, as compared to a case where each toner conveyance path is constituted of both of a horizontal tubular passage and a vertical tubular passage. Thus, a reduction in size of image-forming apparatus 1 in the direction of height is achieved.

On the other hand, because toner-containing units 30Y, 30M, 30C, and 30K are arranged substantially at the same height along the horizontal direction (X-axis direction), when toner container 32 is attached to or detached from container attachment portion 31, with lid member 45 being opened as shown in FIG. 2, such attachment or detachment can be carried out more easily, as compared to a case where the toner-containing units are arranged at an angle with respect to the horizontal direction.

In image-forming apparatus 1, it is generally required not only to merely supply toner to each developer unit, but also to reduce fluctuation in the amount of toner supplied to each developer unit per unit time and to reduce a difference in the amount of toner supply per unit time between different developer units (or between different toner conveyance paths 35).

Figure 7A:
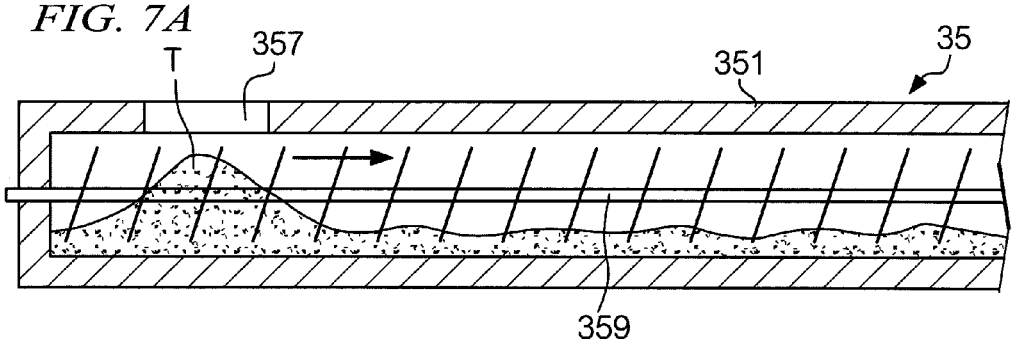
FIGS. 7A-7D are schematic diagrams showing a flow of toner in a toner conveyance path.
Figure 7B:
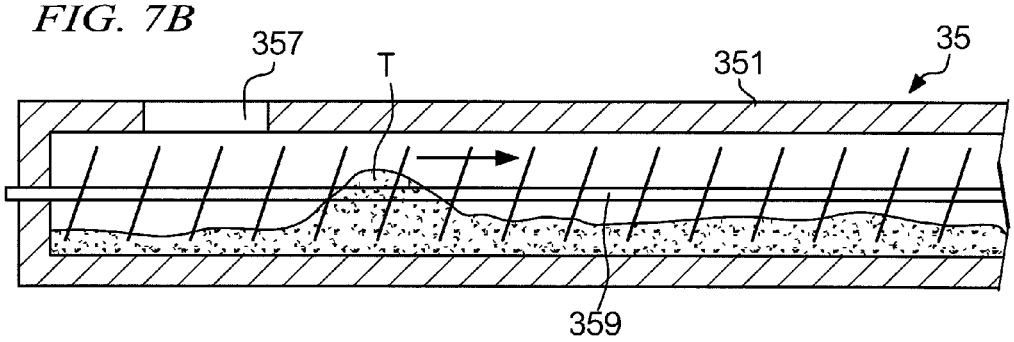
Figure 7C:
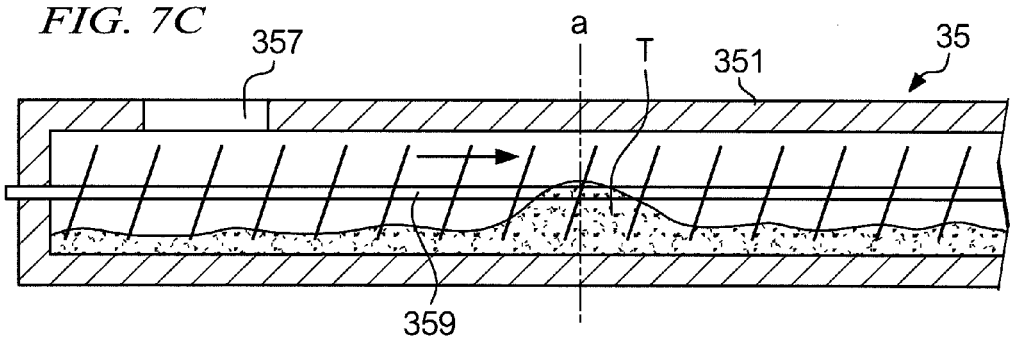
Figure 7D:
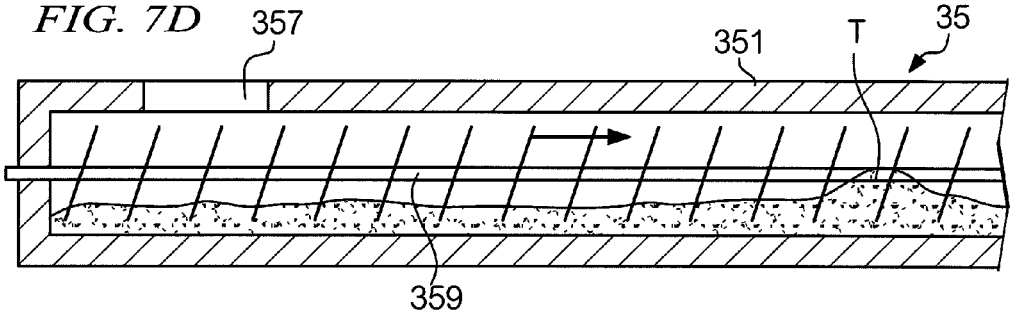

Explanation will now be given of fluctuation in an amount of toner supply per unit time, with reference to the schematic drawings in FIGS. 7A-7D. Toner is constituted of minute particles, which, under influence of temperature, humidity, and/or other factors, may aggregate resulting in agglomeration of the toner. If toner agglomeration T enters toner conveyance path 35 (horizontal tubular passage 351) through toner inlet port 357 as shown in FIG. 7A, toner agglomeration T is conveyed in a direction indicated by an arrow while being disintegrated gradually owing to agitation performed by conveying member 359, as shown in FIGS. 7B-7D. In other words, in a portion of toner conveyance path 35 where toner inlet port 375 is provided, a pile of toner may be formed due to toner agglomeration T and a relatively large amount of toner may be concentrated, but the pile of toner is disintegrated owing to agitation performed by conveying member 359 during conveyance of toner. Therefore, in a case where toner conveyance path 35 has a sufficient length, the pile of toner resulting from toner agglomeration T can be disintegrated and spread over a normal flow of conveyed toner, whereby the fluctuation in an amount of toner supplied per unit time is suppressed.

In contrast, in a case where toner outlet port 358 is provided at a position near toner inlet port 357, such as at point "a" in FIG. 7C, toner agglomeration T will be discharged before it is spread over a normal flow of toner, and hence, an amount of toner supplied to developer unit 5 will be increased from a normal amount. Thus, in the case where toner conveyance path 35 does not have a sufficient horizontal length, fluctuation tends to occur in an amount of toner supply per unit time.

However, even when it is not possible to provide a sufficient horizontal length in toner conveyance path 35, provision of vertical tubular passage 353 at an intermediate portion of horizontal tubular passage 351 can cause the pile of toner resulting from toner agglomeration T to be spread over a normal flow of toner, like the case where toner conveyance path 35 is given a sufficient horizontal length. This is because the toner conveyed to vertical tubular passage 353 falls downward with respect to the direction of gravity through vertical tubular passage 353, and such falling causes agglomerated toner (or a pile of toner) to disintegrate.

As stated in the foregoing, toner conveyance path 35Y is constituted only of horizontal tubular passage 351Y without a vertical tubular passage, and therefore, it is difficult to ensure a sufficient length of toner conveyance path 35Y for suppressing fluctuation in an amount of toner supply per unit time.

Therefore, in toner conveyance path 35Y, small diameter portion 352Y is provided on a toner inlet side of horizontal tubular passage 351Y, while large diameter portion 354Y is provided on a toner outlet side of the same, where the small diameter portion 352Y has a smaller cross-sectional area than large diameter portion 354Y. Such a configuration restricts an amount of toner flowing through horizontal tubular passage 351Y, whereby fluctuation in an amount of toner supplied to developer unit 5Y via toner conveyance path 35Y per unit time is suppressed.

Figure 8A:
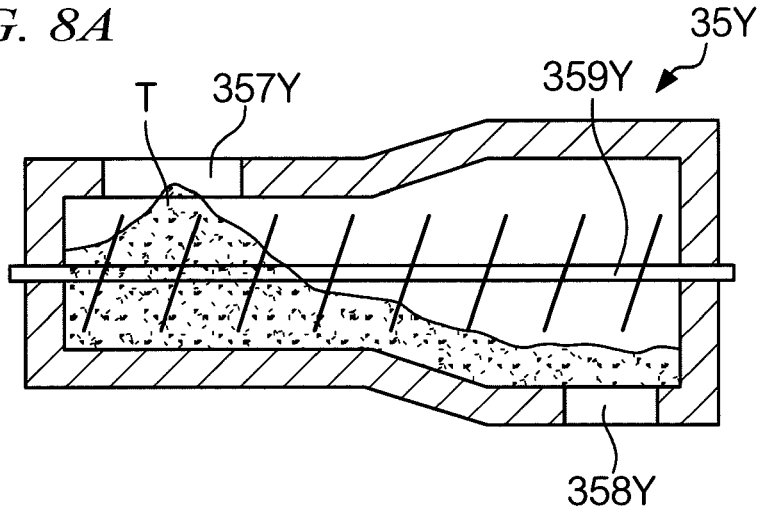
FIGS. 8A-8C are schematic diagrams showing a flow of toner according to an exemplary embodiment of the present invention.
Figure 8B:
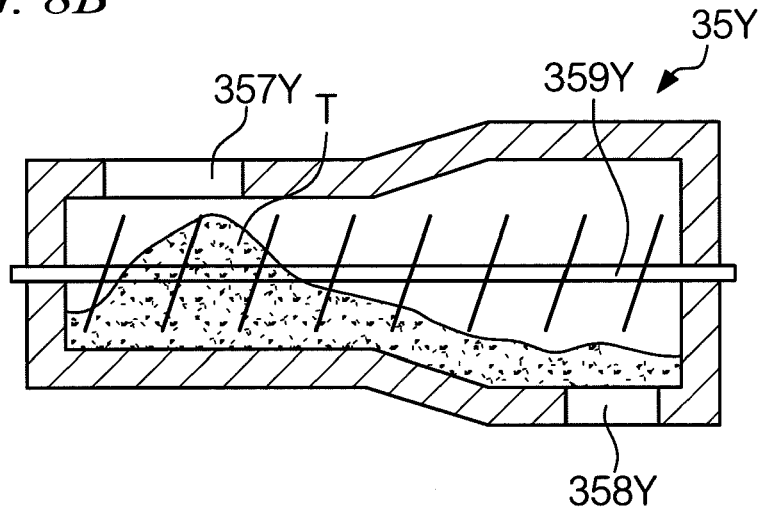
Figure 8C:
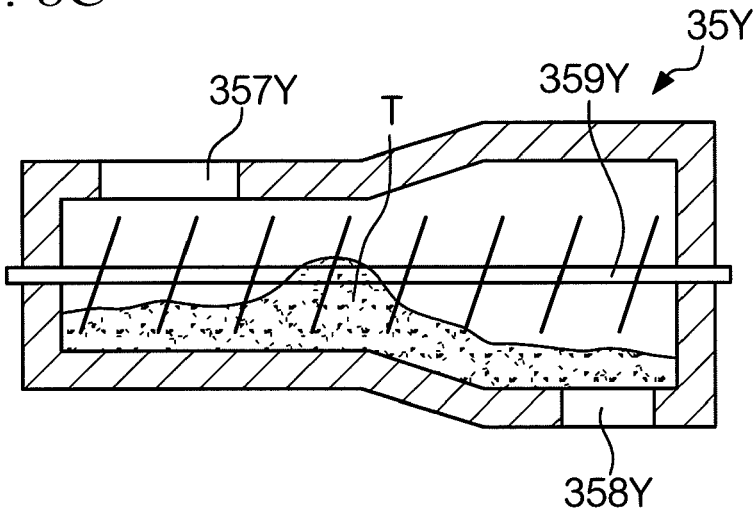

More concrete explanation is given below. Namely, because the cross-sectional area of the conveyance path is smaller in small diameter portion 352Y than in large diameter portion 354Y, an amount of toner conveyed per unit time through small diameter portion 352Y is smaller than that conveyed through large diameter portion 354Y. Therefore, as shown in a schematic diagram of FIG. 8A, toner agglomeration T that has entered through toner inlet port 357Y is not immediately conveyed through small diameter portion 352Y. Rather, toner agglomeration T stays in small diameter portion 352Y until it is disintegrated to a certain extent under the agitation by conveying member 359Y, and, following the state shown in FIG. 8B, toner agglomeration T is conveyed after it is reduced to a size that can move through a space defined between small diameter portion 352Y and conveying member 359Y, as shown in FIG. 8C. Thus, disintegrated toner agglomeration T is spread over a normal flow of toner when it is conveyed, whereby fluctuation in an amount of toner supply per unit time is suppressed in toner conveyance path 35Y, though it includes only horizontal tubular passage 351Y.

In the toner conveyance paths other than toner conveyance path 35Y, i.e., in toner conveyance paths 35M, 35C, and 35K, first horizontal tubular passage 351 and second horizontal tubular passage 352 are connected to each other via vertical tubular passage 353, and the total length of first and second horizontal tubular passages 351, 352 is the same as that of horizontal tubular passage 351Y of toner conveyance path 35Y. In toner conveyance paths 35M, 35C, and 35K, owing to the presence of vertical tubular passage 353, the conveyed toner falls downward under influence of gravity and agglomerated toner (or a pile of toner) disintegrates.

It is also to be noted that the horizontal tubular passage and the conveying member of toner conveyance path 35Y have a shape different from that of the horizontal tubular passage and the conveying member of each of the other toner conveyance paths 35M, 35C, and 35K, so that the difference in the amount of toner supply per unit time between respective developer units 5 is reduced. Specifically, conveying member 359 of each toner conveyance path 35M, 35C, 35K has a larger diameter than conveying member 359Y of toner conveyance path 35Y. For each toner conveyance path 35, when a number of rotations of conveying member 359 is the same, an amount of toner conveyed is determined based on the number, area, and pitch of the vanes of conveying member 359. Therefore, an amount of toner supplied per unit time by conveying member 359 of toner conveyance paths 35M, 35C, and 35K, which has a larger diameter and hence a larger area of vanes, tends to be larger than that supplied by conveying member 359Y of toner conveyance path 35Y.

In other words, to suppress fluctuation in an amount of toner supply per unit time, toner conveyance path 35Y is provided with small diameter portion 352Y on a side close to toner inlet port 357Y to restrict an amount of toner conveyed through toner conveyance path 35Y. As a result, an amount of toner supplied per unit time through toner conveyance path 35Y tends to be smaller than that supplied through each of toner conveyance paths 35M, 35C, and 35K, which are equipped with conveying member 359 having a larger diameter, if no measure is taken.

Therefore, toner conveyance paths 35M, 35C, 35K are adapted to make an amount of toner supplied per unit time through each of these toner conveyance paths comparable to that supplied through toner conveyance path 35Y. An exemplary configuration to achieve it is adopted in toner conveyance path 35K shown in FIG. 6. Specifically, an upstream portion of a shaft of first conveying member 359K in toner conveyance path 35K is given a smaller diameter than a downstream portion of the same, whereby the vanes protruding from the downstream portion of the shaft have a smaller area than the vanes protruding from the upstream portion of the shaft, while the diameter of the helix configured by the vanes is substantially unchanged between the upstream portion and the downstream portion. In this way, an amount of toner conveyed through large-diameter shaft portion 361K is made smaller than that conveyed through small-diameter shaft portion 360K, and this contributes to reducing a difference in an amount of toner supply per unit time between different toner conveyance paths 35.

<2. Modified Embodiments>

The foregoing exemplary embodiment may be modified as described in the following.

In the above-described exemplary embodiment, the shape of the horizontal tubular passage and the conveying member of toner conveyance path 35Y is made different from that of the horizontal tubular passage and the conveying member of each of the other toner conveyance paths 35M, 35C, and 35K, to reduce the fluctuation in the amount of toner supplied to each developer unit 5 per unit time and to reduce the difference in the amount of toner supply per unit time between different developer units 5. It is to be noted that the shape of the horizontal tubular passage and the conveying member is not limited to that shown in the exemplary embodiment, and may be of another shape.

Also, it is possible to change the number of rotations per unit time of the conveying member of toner conveyance path 35Y from that of the conveying member of the other conveyance paths 35M, 35C, and 35K, to reduce the difference in the amount of toner supply per unit time between different conveyance paths 35. In a concrete example where all of the conveying members are rotated by a single drive source via respective gear trains, the gear ratio of each gear train is adjusted such that the number of rotations per unit time of conveying member 359Y of toner conveyance path 35Y is greater than that of conveying member 359 of the other conveyance paths 35M, 35C, 35K. Further, in another example where each conveying member is rotated by a respective drive source, the drive sources are controlled such that the number of rotations of conveying member 359Y of toner conveyance path 35Y is greater than that of conveying member 359Y of the other conveyance paths 35M, 35C, 35K, and/or, a period in which conveying member 359Y of toner conveyance path 35Y is rotated is longer than a period in which conveying member 359Y of the other conveyance paths 35M, 35C, 35K is rotated.

Further, in the exemplary embodiment, toner-containing units 30Y, 30M, 30C, and 30K are arranged at the same height along the horizontal direction (X-axis direction), and developer units 5Y, 5M, 5C, and 5K are arranged along a direction inclined at an angle with respect to the horizontal direction (X-axis direction). However, toner-containing units 30Y, 30M, 30C, and 30K may be arranged along a direction inclined with respect to the horizontal direction at an angle smaller than the angle of inclination of the direction along which developer units 5Y, 5M, 5C, and 5K are arranged.

The foregoing description of the embodiments of the present invention is provided for the purposes of illustration and description. It is not intended to be exhaustive or to limit the invention to the precise forms disclosed. Obviously, many modifications and variations will be apparent to practitioners skilled in the art. The embodiments were chosen and described to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image-forming apparatus comprising:

a plurality of image-forming units arranged along a direction inclined at an acute angle with respect to a horizontal direction, each of the plurality of image-forming units forming an image with developer;

a plurality of developer-containing units positioned above the plurality of image-forming units and arranged along the horizontal direction or along a direction inclined with respect to the horizontal direction at an angle smaller than the acute angle, each of the plurality of developer-containing units containing the developer supplied to an associated one of the plurality of image-forming units; and a plurality of developer conveyance paths that connect the plurality of image-forming units to respective developer-containing units, each developer conveyance path having a tubular passage that defines a space through which the developer contained in the associated developer-containing unit is conveyed to the associated image-forming unit, wherein the tubular passage of a developer conveyance path connected to an image-forming unit located at a position higher than that of another image-forming unit has a vertically extending portion shorter than that of the tubular passage of a developer conveyance path connected to the another image-forming unit.

2. The image-forming apparatus according to claim 1, wherein a developer conveyance path connected to one of the plurality of image-forming units that is positioned highest has only a tubular passage that extends in a direction perpendicular to a vertical direction, and each of the other developer conveyance paths has a first tubular passage that extends in a direction perpendicular to the vertical direction and a second tubular passage that extends in the vertical direction.

3. The image-forming apparatus according to claim 2, wherein the tubular passage of the developer conveyance path connected to the highest positioned image-forming unit has a shape different from that of the first tubular passage of each of the other developer conveyance paths.

4. The image-forming apparatus according to claim 2, wherein the tubular passage of the developer conveyance path connected to the highest positioned image-forming unit and the first tubular passage of each of the other developer conveyance paths are each provided with a conveying member that conveys developer, and the conveying member provided in the tubular passage of the developer conveyance path connected to the highest positioned image-forming unit has a shape different from that of the conveying member provided in the first tubular passage of each of the other developer conveyance paths.

5. The image-forming apparatus according to claim 2, wherein the tubular passage of the developer conveyance path connected to the highest positioned image-forming unit has a small diameter portion at a developer inlet side of the tubular passage and a large diameter portion at a developer outlet side of the tubular passage.

6. The image-forming apparatus according to claim 2, wherein the first tubular passage of each of the other developer conveyance paths is provided with a conveying member that conveys developer, the conveying member having a shaft and vanes arranged on the shaft in a helical manner, and the shaft has a small diameter section at a developer inlet side of the first tubular passage and a large diameter section at a developer outlet side of the first tubular passage.

7. The image-forming apparatus according to claim 2, wherein the tubular passage of the developer conveyance path connected to the highest positioned image-forming unit and the first tubular passage of each of the other developer conveyance paths are each provided with a conveying member that is rotated to convey developer, and a number of rotations per unit time of the conveying member provided in the tubular passage of the developer conveyance path connected to the highest positioned image-forming unit is greater than a number of rotations per unit time of the conveying member provided in the first tubular passage of each of the other developer conveyance paths.

8. The image-forming apparatus according to claim 2, wherein the tubular passage of the developer conveyance path connected to the highest positioned image-forming unit and the first tubular passage of each of the other developer conveyance paths are each provided with a conveying member that is rotated to convey developer, and a period in which the conveying member provided in the tubular passage of the developer conveyance path connected to the highest positioned image-forming unit is rotated is longer than a period in which the conveying member provided in the first tubular passage of each of the other developer conveyance paths is rotated.

9. The image-forming apparatus according to claim 1, wherein a length of the vertically extending portion of the tubular passage of a developer conveyance path connected to one of the plurality of image-forming units that is positioned highest is zero.

* * * * *